US006183065B1

(12) United States Patent
Suetsugu et al.

(10) Patent No.: US 6,183,065 B1
(45) Date of Patent: Feb. 6, 2001

(54) CONTROL SYSTEM FOR APPLYING BIASING AND RECORDING SIGNALS TO RECORDING ELECTRODES OF AN ELECTROSTATIC INK JET RECORDING DEVICE

(75) Inventors: Junichi Suetsugu; Yoshihiro Hagiwara; Kazuo Shima; Tadashi Mizoguchi; Hitoshi Minemoto; Hitoshi Takemoto; Toru Yakushiji, all of Niigata (JP)

(73) Assignee: NEC Corporation (JP)

( * ) Notice: Under 35 U.S.C. 154(b), the term of this patent shall be extended for 0 days.

(21) Appl. No.: 09/139,248

(22) Filed: Aug. 25, 1998

(30) Foreign Application Priority Data

Aug. 27, 1997 (JP) ..... 9-231387

(51) Int. Cl.[7] ..... B41J 2/04
(52) U.S. Cl. ..... 347/55
(58) Field of Search ..... 347/55, 120, 123, 347/111, 159, 141, 128, 17, 103, 154

(56) References Cited

U.S. PATENT DOCUMENTS 5,631,679 * 5/1997 Kagayama ..... 347/55

FOREIGN PATENT DOCUMENTS 3-190747 8/1991 (JP) .
4-80037 3/1992 (JP) .

* cited by examiner

*Primary Examiner*—John Barlow
*Assistant Examiner*—Raquel Yvette Gordon
(74) *Attorney, Agent, or Firm*—Ostrolenk, Faber, Gerb & Soffen, LLP

(57) ABSTRACT

An electrostatic ink jet recording device includes a recording head having an ink chamber receiving therein liquid ink containing electrified toner particles and a plurality of recording electrodes for ejecting the toner particles from the liquid ink. Each of the recording electrodes is applied with a bias pulse train when the recording head resides in a printing area and a non-printing area, and a selected group of the recording electrodes are applied with a constant recording signal for ejection of toner particles. Undesirable ejection of the toner particles in the non-printing area is avoided by the application of the bias pulse train.

7 Claims, 4 Drawing Sheets

CONTROL SYSTEM FOR APPLYING BIASING AND RECORDING SIGNALS TO RECORDING ELECTRODES OF AN ELECTROSTATIC INK JET RECORDING DEVICE

BACKGROUND OF THE INVENTION (a) Field of the Invention

The present invention relates to an electrostatic ink jet recording device and, more particularly, to an electrostatic ink jet recording device including a recording head for ejecting ink containing electrified toner particles.

(b) Description of the Related Art

A non-impact recording technique has drawn attention due to its small noise during a recording operation. Among other non-impact recording techniques, an electrostatic ink jet recording technique is superior because it can record images directly on a recording sheet at a high speed with a simple mechanism. Various devices have been proposed for implementing the electrostatic ink jet recording technique.

JP-A-4(1996)-80037 proposes an ink jet recording device, as shown in FIG. 1, wherein the entire spacing area 34 in which a recording head 31 in the recording device 30 moves in the transverse direction of a recording sheet 35 is divided into three areas including a printing area 32 and a pair of non-printing areas 33 disposed at both sides of the printing area 32. The recording head 31 has a plurality of ink ejection nozzles aligned in the transverse direction of the recording sheet for ejection of the ink.

FIG. 2 schematically shows the longitudinal section of the nozzle surface of the recording head 31, wherein the plurality of ink ejection nozzles 41 are aligned, for showing the situation of the individual ink ejection nozzles 41 when the recording head resides in the printing area 32 and the non-printing areas 33.

In FIG. 2, "ON" and "OFF" means application of recording voltages to individual ink ejection nozzles 41. A low bias voltage is applied to all of the ink ejection nozzles 41 when the recording head 31 resides in the non-printing area 33, whereas a specified group of ink ejection nozzles 41 are driven with a higher, printing pulse train when the recording head 31 resides in the printing area 32. In this example, the printing pulse train is not applied to the two when the recording head 31 resides in the printing area 32.

FIG. 2 shows the shape of ink meniscuses 43 and 42 on the nozzle surface in the printing area 32 and the non-printing area 33. In the non-printing area 33, the nozzle surface gets wet with ink due to the application of the small bias voltage to the ink ejection nozzles 41, thereby a small ink meniscus 42 to be formed between each adjacent two of the ink ejection nozzles 41. It is stated in the publication that the small ink meniscus 42 provides an excellent ejection of ink droplets 43, the direction of which is substantially normal to the nozzle surface, when the specified ink ejection nozzles 41 are driven by the printing pulse train.

In the proposed ink jet printing device as mentioned above, although the bias voltage is below a threshold voltage for ejection of ink droplets, the bias voltage applied in the non-printing area sometimes causes an undesirable ink ejection from the ink ejection nozzles depending on the situations of the nozzle surface, that is, a lightly wet state or a heavily wet state of the nozzle surface.

SUMMARY OF THE INVENTION

In view of the above, it is an object of the present invention to provide an electrostatic ink jet recording device which is capable of providing an excellent and stable ejection of ink droplets substantially without causing an undesirable ink ejection.

The present invention provides an electrostatic ink jet recording device comprising: a recording head for moving between a printing area and a non-printing area, the recording head having an ink chamber for receiving therein liquid ink containing electrified toner particles, and a plurality of recording electrodes, disposed in operative relationship with the liquid ink, for ejecting the electrified toner particles when the recording head resides in the printing area; a counter electrode disposed opposite to the recording electrodes; and a control unit for applying a bias signal to all of the recording electrodes and a recording signal to a selected group of the recording electrodes with respect to the counter electrode, the bias signal and the recording signal being implemented by a pulse train and a constant voltage, respectively.

In accordance with the electrostatic ink jet recording device of the present invention, the bias pulse train causes less undesirable ink ejection during application of the bias pulse train in the non-printing area because the mean magnitude of the bias pulse train is lower than a constant bias voltage having a same voltage as the peak voltage of the bias pulse train, thereby achieving an excellent and stable ink ejection from the recording head.

The above and other objects, features and advantages of the present invention will be more apparent from the following description, referring to the accompanying drawings.

PREFERRED EMBODIMENT OF THE INVENTION

Figure 1:
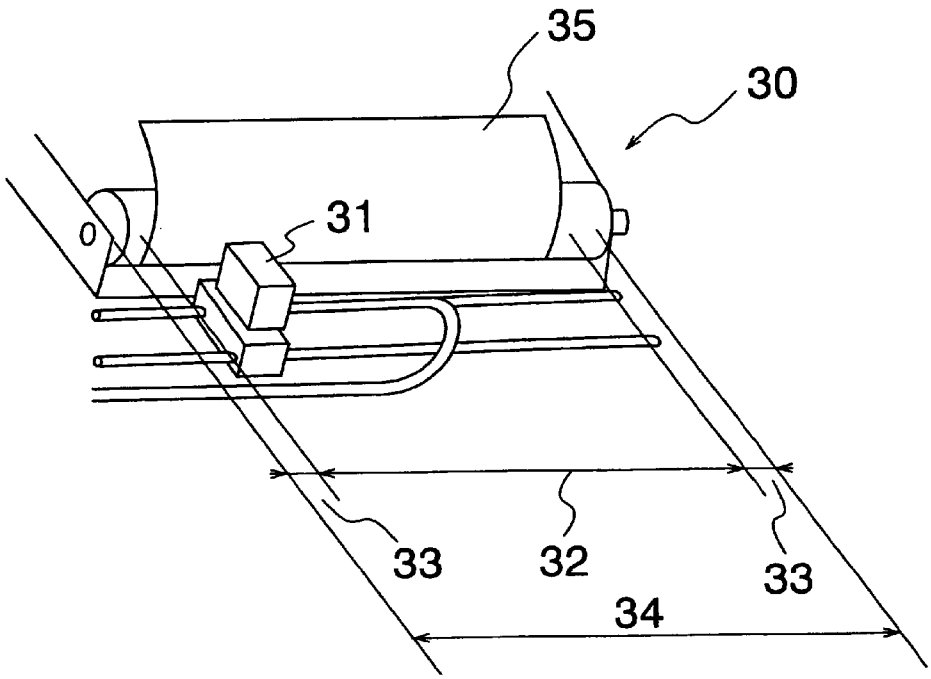
FIG. 1 PRIOR ART
FIG. 1 is a perspective view of a conventional electrostatic ink jet recording device.
Figure 2:
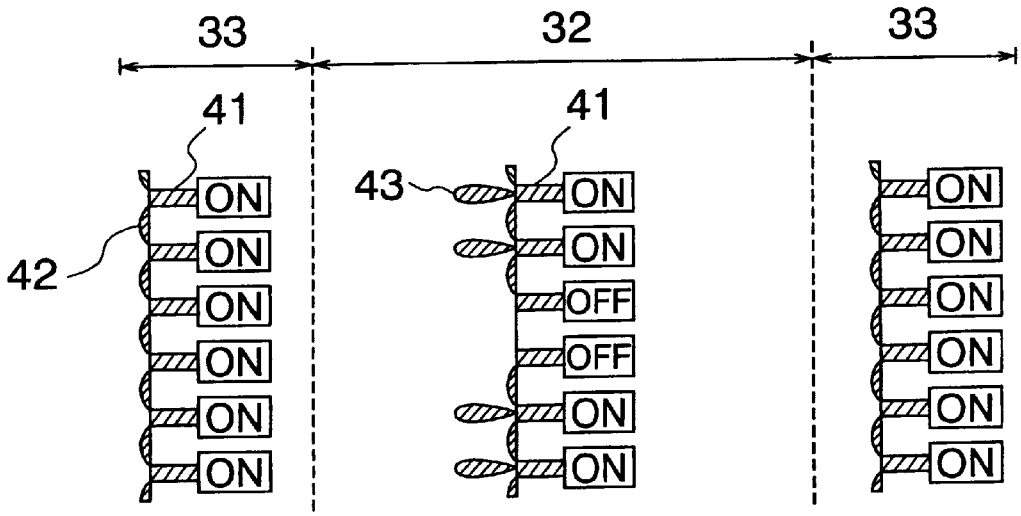
FIG. 2 PRIOR ART
FIG. 2 is a schematic longitudinal-sectional view of the nozzle surface of the recording head shown in FIG. 1 when the recording head resides in the printing area and the non-printing area.
Figure 3:
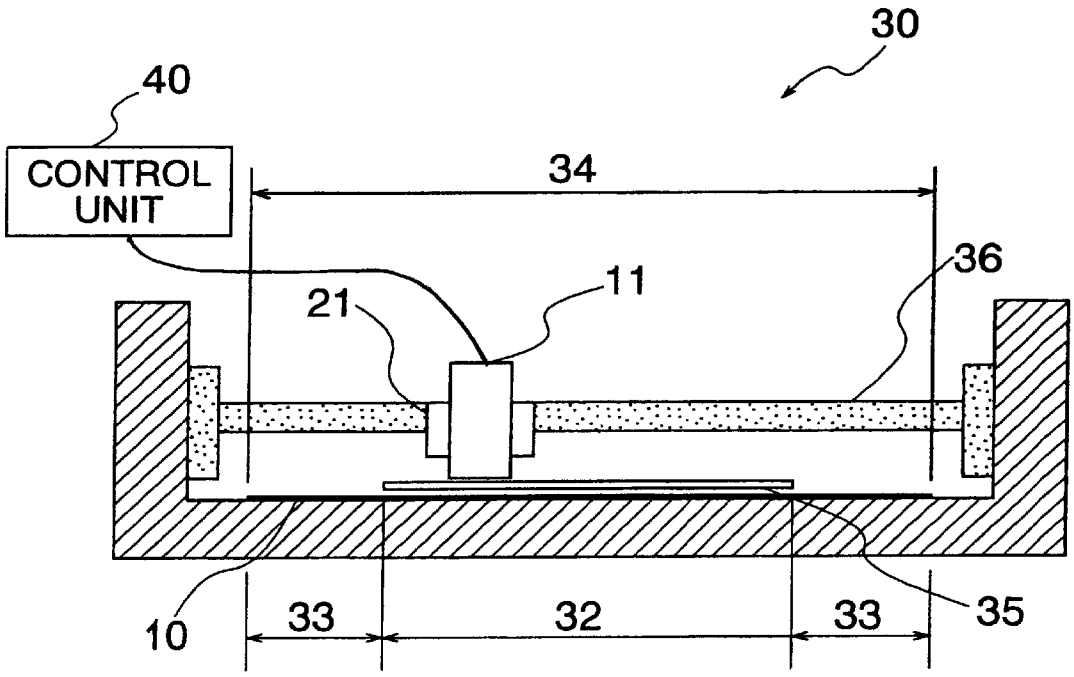
FIG. 3 is a front view of an electrostatic ink jet recording device according to an embodiment of the present invention.

Now, the present invention is more specifically described with reference to accompanying drawings, wherein similar constituent elements are designated by similar reference numerals. Referring to FIG. 3, an electrostatic ink jet recording device 30 according to an embodiment of the present invention has a recording head 11 mounted on a head carriage 21 which is slidably supported by a shaft 36, and a control unit 40 for driving and controlling the recording head 11. The recording head 11 moves along the shaft 36 in the spacing area 34 including a pair of non-printing areas 33 and a printing area 32 for recording images onto a recording sheet 35 disposed in the printing area 32. In the spacing area 34, a counter electrode 10 is disposed at the back of the recording sheet 35 for assisting the ink ejection by the recording head 11.

Figure 4:
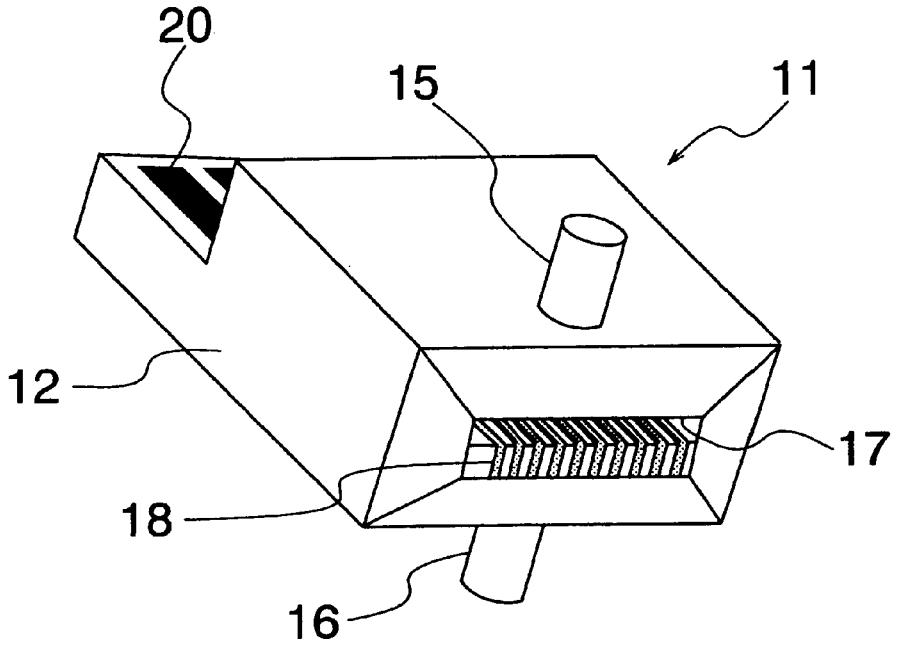
FIG. 4 is a perspective view of the recording head shown in FIG. 3.

Referring to FIG. 4 showing the recording head 11, in a perspective view, as viewed from the bottom thereof, the recording head 11 has a housing 12 defining an ink chamber therein and an ink ejection slit 17 at the bottom surface opposing the recording sheet 35. The housing 12 has an ink inlet port 15 and an ink outlet port 16 both connected to the ink chamber. An ink ejection member 18 having an edge exposed through the ink ejection slit 17 is installed in the housing 12.

Figure 5:
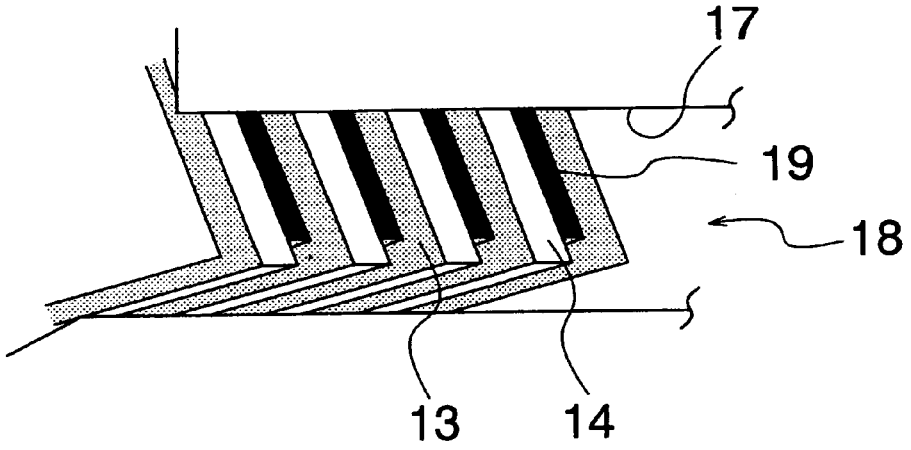
FIG. 5 is an enlarged perspective view of the nozzle surface of the recording head of FIG. 4.

Referring to FIG. 5 showing the detail of the ink ejection member 18, the ink ejection member 18 is substantially of hexahedron made of ceramics or glass, having a plurality of ink channels 13 each extending from the ink chamber toward the exposed edge of the ink ejection member 18. The edge of each ink channels 13 constitutes an ink ejection nozzle. The ink channels 13 are arranged at 300DPI pitches, that is, 85 $\mu$m intervals, for example. The depth of ink channel 13 is about 100 $\mu$m and the width thereof is about 65 $\mu$m. Thus, the thickness of the wall 14 separating adjacent ink channels 13 is about 20 $\mu$m.

A recording electrode 19 is disposed on the bottom of each of the ink channels 13 formed on the upper surface of the ink ejection member 18. The recording electrode 19 extends from the ink ejection nozzle toward the rear side of the ink ejection member 18. Each recording electrode 19 is connected to a pad 20 (FIG. 4) disposed at the top side of the recording head 11 for transferring a recording signal together with a bias signal from the control unit 40, each of the recording signal and the bias signal having a positive polarity with respect to the counter electrode 10. The recording electrode 19 is formed as by patterning a sputtered Cu film having a thickness of about 1 $\mu$m. The ink channels 13 are formed by dicing the two surfaces of the ceramic body in this embodiment. Alternatively, a molded alumina body having a plurality of ink channels may be used for the ink ejection member. The recording electrode 19 may be formed on the bottom and side surfaces of the ink channel 13.

The ink chamber of the recording head 11 is connected to an ink tank not shown in the figure through a tube to circulate the liquid ink by a pump along with a negative pressure of about 1 cm-$H_2O$ in the ink chamber. The liquid ink is made of a petroleum organic solvent (isoparaffin), or a silicone oil, into which colored (toner) particles made of thermoplastic resins are dispersed together with an electrification control agent. The toner particles have a pseudo-positive potential due to electrification by a zeta potential.

The toner particles are driven toward the ink ejection nozzle by an electrophoretic force formed by the bias signal applied to the recording electrodes 19 with respect to the counter electrode 10, thereby raising the toner concentration in the liquid ink in the vicinity of the ink ejection nozzle. When a recording signal is additionally applied to selected recording electrodes, the toner particles in the vicinity of the ink ejection nozzles corresponding to the selected recording electrodes are ejected toward a recording sheet. The toner particles not ejected from the ink ejection nozzles return through the ink channel 13 formed on the lower surface of the ink ejection member 18.

Figure 6:
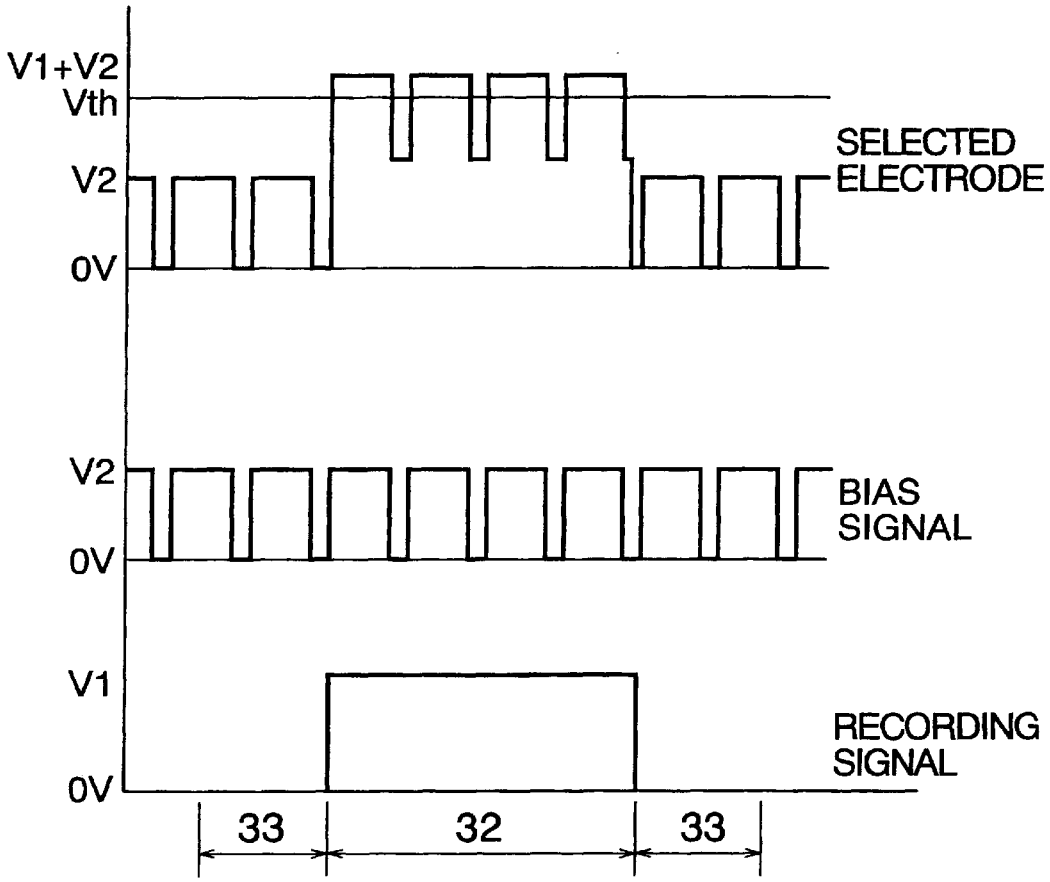
FIG. 6 is a timing chart of driving signals applied to the recording head of FIG. 4.

Referring to FIG. 6, there are shown signal timing charts including the potential of a selected recording electrode, the bias signal applied to all of the recording electrodes and the recording signal applied to the selected recording electrode. In the present embodiment, the bias signal is a pulse train having a positive peak voltage of V2 which is lower than a threshold voltage Vth over which the toner particles are ejected from the ink ejection nozzle, whereas the recording signal is a constant voltage of V1. The bias pulse train is applied to all of the recording electrodes irrespective of wherever the recording head resides, that is, in the recording area as well as in the non-recording are. The recording signal is applied to the selected recording electrode when the recording head resides in the recording area.

By applying both the bias signal and the recording signal to the selected recording electrode, the potential of the selected recording electrode as well as the surface potential of the ink in the vicinity thereof rises up to V1+V2 which exceeds the threhsold voltage Vth. Thus, the toner particles in the vicinity of the selected recording electrode are ejected from the ink meniscus toward the counter electrode as ink droplets, forming an image on the recording sheet. The ink droplets forming the image are then heated and fixed onto the recording sheet by using a heater.

The pulse train used as the bias signal provides an advantage in that the effective or mean magnitude of the bias voltage is lowered compared to a constant voltage having a same voltage as the peak voltage of the pulse train, which fact suppresses occurrence of an undesired ink ejection from the ink ejection nozzle. The combination of the pulse train of the bias signal and the constant recording signal provides a biased pulse train wherein each pulse does not fall to a ground potential but remains at an intermediate potential V2. The intermediate potential V2 applied to the selected recording electrode functions for collecting the toner particles toward the ink ejection nozzle between the intermittent ejection of the ink droplets. The intermediate potential V2 applied to non-selected recording electrodes provides a function for collecting the toner particles toward the ink ejection nozzle at any time, which provides a desirable toner concentration when the non-selected recording electrodes are selected in the next time instant.

Since the above embodiments are described only for examples, the present invention is not limited to the above embodiments and various modifications or alterations can be easily made therefrom by those skilled in the art without departing from the scope of the present invention.

What is claimed is:

1. An electrostatic ink jet recording device comprising:

a recording head for moving between a printing area and a non-printing area, said recording head having an ink chamber for receiving therein liquid ink containing electrified toner particles, and a plurality of recording electrodes, disposed in operative relationship with the liquid ink, for ejecting the electrified toner particles when said recording head resides in said printing area;

a counter electrode disposed opposite to said plurality of recording electrodes; and a control unit for applying a non-zero bias signal to all of said recording electrodes and additionally applying a recording signal to a selected group of said recording electrodes with respect to said counter electrode, said bias signal being comprised of a pulse train and said recording signal being comprised of a constant voltage signal, said bias signal being applied to said recording electrodes both when said recording head is located in said printing area and when said recording head is located in said non-printing area.

2. An ink jet recording device as defined in claim 1, wherein said control unit that applies said bias signal when said recording head resides in said recording area and said non-recording area, applies said recording signal when said recording head resides in said recording area.

3. An ink jet recording device as defined in claim 1, wherein said bias signal has a peak voltage below a threshold voltage over which said recording electrodes eject the electrified toner particles, and wherein a sum of said peak voltage and the constant voltage exceeds said threshold voltage.

4. An electrostatic ink jet recording device, comprising:

a recording head movable across a printing area, said recording head having an ink chamber for receiving a liquid ink containing electrified toner particles and a plurality of recording electrodes disposed in operative relationship with said liquid ink for ejecting said electrified toner particles upon the application of a sufficient voltage thereto;

a counter electrode disposed opposite to said plurality of recording electrodes; and a control unit for:

continually applying a bias signal in the form of a pulse train to each of said recording electrodes as said recording head is moved across said printing area, said bias signal being insufficient to cause said electrified toner particles to be ejected from said recording head; and periodically applying a recording signal in the form of a constant voltage to at least some of said recording electrodes as said recording head moves across said printing area so that both said bias signal and said recording signal are periodically simultaneously applied to said at least some recording electrodes to selectively cause said electrified toner particles to be ejected from said recording head towards said counter electrode.

5. The electrostatic recording device of claim 4, wherein said recording head is movable across a non-printing area as well as said printing area and wherein said control unit also applies said bias signal to said recording electrodes while said recording head is moved across said non-printing area.

6. A method for operating an electrostatic ink jet recording device of the type which includes a recording head moveable across a printing area, said recording head having an ink chamber for receiving a liquid ink containing electrified toner particles and a plurality of recording electrodes disposed in operative relationship with said ink for ejecting said electrified toner particles upon the application of a sufficient voltage thereto and a counter electrode disposed opposite to said plurality of recording electrodes, said method comprising:

continually applying a bias signal in the form of a pulse train to each of said recording electrodes as said recording head is moved across said printing area, said bias signal being insufficient to cause said electrified toner particles to be ejected from said recording head; and periodically applying a recording signal in the form of a constant voltage to at least some of said recording electrodes as said recording head moves across said printing area so that both said bias signal and said recording signal are periodically simultaneously applied to said at least some recording electrodes to selectively cause said electrified toner particles to be ejected from said recording head towards said counter electrode.

7. The method of claim 6, wherein said recording head is moveable across a non-printing area as well as said printing area and wherein said bias signal is also applied to said recording electrodes while said recording head is moved across said non-printing area.

* * * * *